US010784637B2

(12) United States Patent
Barnett et al.

(10) Patent No.: US 10,784,637 B2
(45) Date of Patent: Sep. 22, 2020

(54) COMFORTABLY OPERATED TRAVEL PLUG ADAPTER

(71) Applicant: TRAVEL BLUE LTD., Edgware, Middlesex (GB)

(72) Inventors: Alasdair Max Paul Barnett, Cambridgeshire (GB); Richard Albert Norman, Ely (GB); Bruce Stanley John Hutchison, Cottenham (GB)

(73) Assignee: TRAVEL BLUE LIMITED, Edgware, Middlesex (GB)

( * ) Notice: Subject to any disclaimer, the term of this patent is extended or adjusted under 35 U.S.C. 154(b) by 0 days.

(21) Appl. No.: 16/346,852

(22) PCT Filed: Nov. 1, 2017

(86) PCT No.: PCT/EP2017/077976
§ 371 (c)(1),
(2) Date: May 1, 2019

(87) PCT Pub. No.: WO2018/083129
PCT Pub. Date: May 11, 2018

(65) Prior Publication Data

US 2019/0312395 A1 Oct. 10, 2019

(30) Foreign Application Priority Data

Nov. 1, 2016 (EP) ..... 16196766

(51) Int. Cl.
*H01R 4/66* (2006.01)
*H01R 31/06* (2006.01)
(Continued)

(52) U.S. Cl.
CPC ..... *H01R 31/06* (2013.01); *H01R 13/35* (2013.01); *H01R 13/502* (2013.01); *H01R 27/00* (2013.01)

(58) Field of Classification Search
CPC ..... H01R 31/06; H01R 27/00; H01R 13/502; H01R 13/35; H01R 27/02; H01R 13/629; H01R 13/514
(Continued)

(56) References Cited

U.S. PATENT DOCUMENTS 7,220,139 B1 * 5/2007 Chang et al. ..... H01R 29/00 439/172
9,083,125 B2 * 7/2015 Rogers ..... H01R 27/00
(Continued)

*Primary Examiner* — Abdullah A Riyami
*Assistant Examiner* — Nelson R. Burgos-Guntin
(74) *Attorney, Agent, or Firm* — Weiner & Burt P.C.; Irving M Weiner; Pamela S Burt

(57) ABSTRACT

The present invention relates to a travel plug adapter, which will also be referred to herein as a travel adapter, for short. Using such an adapter it is possible to insert power plugs of a certain (domestic) standard into the outlets present at the travel destination. The present invention relates in particular to a travel plug adapter (10), which has a housing, a plug receptacle (16), and at least a first plug (38, 84) of a first standard and a second plug (28, 86) of a second standard, wherein each plug is assigned an actuation slider (22, 24), which is guided outwardly through a slide slot (42) of the housing and is designed to displace the plug between a standby position, in which the plug is disposed substantially inside the housing, and a usage position, in which the plug is usably disposed outside the housing, and wherein the first plug (38, 84) is assigned a first blocking element (106A), such that displacement of the first plug (38, 84) between the standby position and the usage position is blocked when the movement of the first blocking element (106A) is blocked, and wherein the second plug (28, 86) is assigned a second blocking element (106B), such that the displacement of the second plug (28, 86) between the standby position and the usage position is blocked when the movement of the second blocking element (106B) is blocked, characterised in that at
(Continued)

Figure 1:
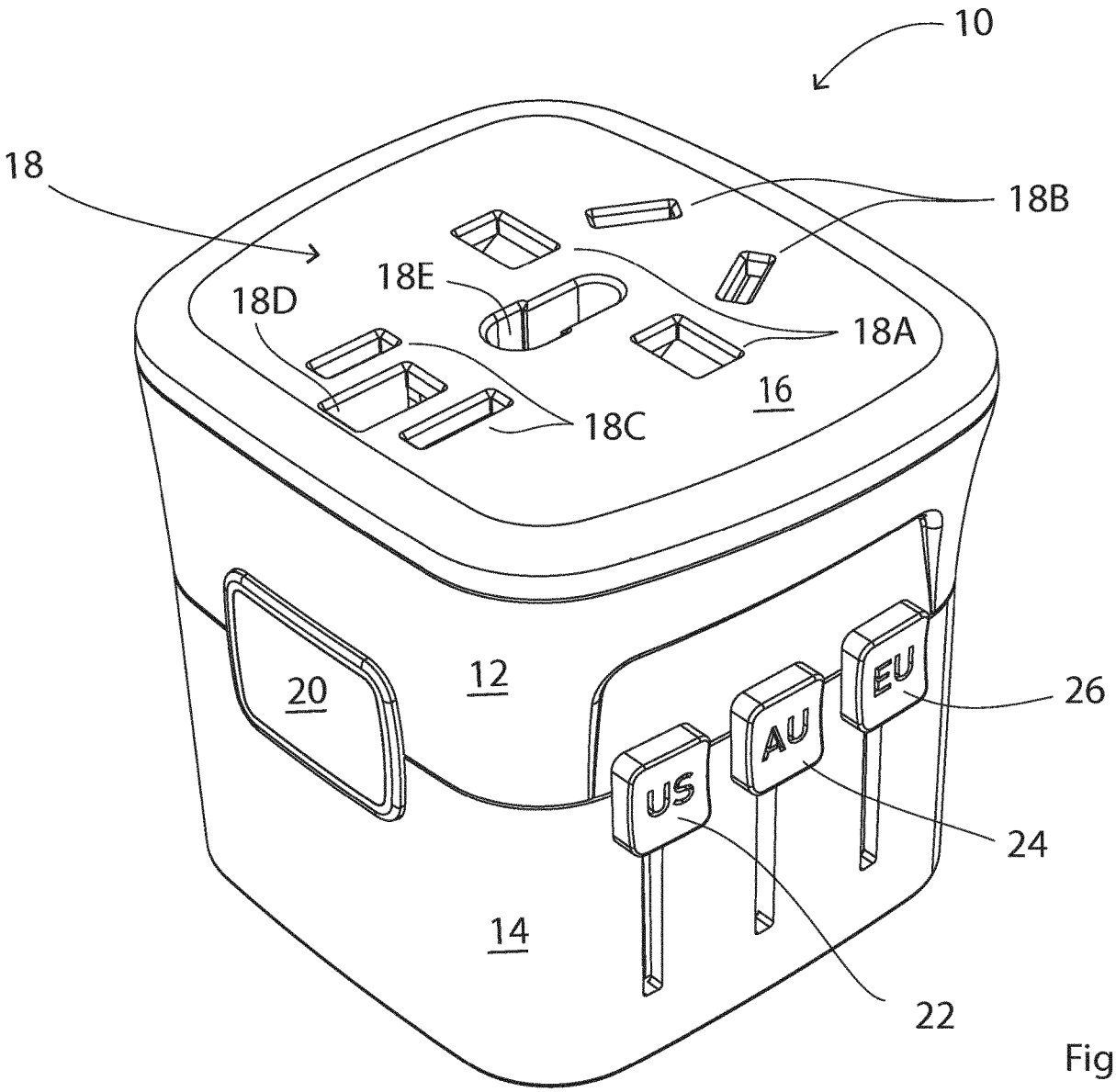

least one blocking slide (100A) is also provided, which in a first position releases the path of the first blocking element (106A) and in a second position blocks the path of the first blocking element (106A), wherein the second blocking element (106B) acts on the position of the blocking slide (100A).

20 Claims, 9 Drawing Sheets

(51) Int. Cl.
*H01R 13/35* (2006.01)
*H01R 13/502* (2006.01)
*H01R 27/00* (2006.01)

(58) Field of Classification Search
USPC ..... 439/151
See application file for complete search history.

(56) References Cited

U.S. PATENT DOCUMENTS 9,231,332 B2 * 1/2016 Chai ..... H01R 13/502
2019/0312395 A1 * 10/2019 Barnett et al. ..... H01R 31/06

* cited by examiner

COMFORTABLY OPERATED TRAVEL PLUG ADAPTER

FIELD OF THE INVENTION

The present invention relates to a travel plug adapter, which will also be referred to herein as a travel adapter, for short. Using such an adapter it is possible to insert power plugs of a certain (domestic) standard into the outlets present at the travel destination. To this end, the travel plug adapter needs a plug receptacle of a first standard and a power plug of another standard. In this case, the issue more precisely is a travel plug adapter that can be inserted into outlets of at least a first standard and a second standard. To this end, power plugs of a first standard and a second standard may be used alternatively in the travel plug adapter.

BACKGROUND OF THE INVENTION

Travel plug adapters or travel adapters of this type are being used more and more in times of increasing global travel and commerce. There is therefore a need for compact, easily transportable travel plug adapters that are suitable for outlets of a number of different standards.

Chinese patent application CN 101872911 A discloses a travel plug adapter having an essentially round housing. Power plugs are housed in the interior of the housing and may be moved out of the housing. In this manner at least three different types of power plugs may be used. The desired power plug is selected in that the upper housing part is rotated relative to the lower housing part. The upper housing part has an individual actuation slider that projects outward. This actuation slider may be caused to engage with various power plug elements. To this end the slider is rotated into a position above the power plug that is to be moved out of the housing from below.

This travel plug may be useful for many purposes. However, it would be desirable to provide a travel adapter which can be operated more easily still. In particular, it would appear to be advantageous if different plugs are assigned different control elements and if the plug can be transferred into the usage position by operation of the assigned control element.

German patent DE 10 2011 014 920 B4 discloses another travel adapter, which is called a universal plug adapter. In this travel adapter, a plurality of sets of pins are provided in an exterior housing. Each set of pins is connected to a control element with which it may be moved from outside. The control elements are guided for this purpose in the housing by slide slots. The control elements are also guided using a blocking plate provided inside the exterior housing. This blocking plate has a guide track, and the control elements can move through the recesses thereof. The guide track provides an upper end position and a lower end position. The blocking plate is resiliently pre-stressed so that a control element may be securely retained in the upper end position or in the lower end position. The control element, and thus the corresponding set of pins, may be released from the end positions and moved upward or downward in that a selector lever also provided outside in addition to the control elements is actuated. Pressing this selector lever moves the blocking plate against the spring force. In this way the pins may be moved out of their upper or lower end position using the control elements.

In this solution, the outer control elements are used both for moving the sets of pins out of a first end position, a standby position, into a second end position, a usage position, and for locking the sets of pins in these positions. It is a drawback that the selection lever must also be operated during the movement of the sets of pins using the control elements. This prevents comfortable one-hand operation. The control elements also take up a lot of space on the plug surface. This prevents a free design-oriented configuration and attaining a compact structural form.

The object of the present invention is to make available an improved travel plug adapter that avoids the drawbacks of the prior art. The travel adapter should be able to be produced cost-effectively and reliably, should be easy to transport and operate, and should be very safe electrically.

The inventive travel plug adapter has a housing that may have various shapes. For instance, as a rule a block shape is practical for transport. However, the mechanics of the travel plug adapter are designed such that the housing shape may largely be freely selected. It is advantageous when the housing has at least one flat side, but the mechanics may also be adapted to curved housing surfaces. The housing may be embodied in one piece or in a plurality of pieces. It has proved useful to embody the housing in two parts, specifically with a lower housing part and an upper housing part. These may be detachably connected to one another, for instance using mechanical means, usefully using a screw connection.

The housing should have at least one plug receptacle. The latter is usefully provided on the housing upper side. The plug receptacle may have different shapes, depending on the type of power plug (hereinafter "plug" for short) to be received. For instance, if a Schuko plug is to be received, the plug receptacle will have an essentially cylindrical depression and in addition female connectors for receiving the contact pins of the Schuko plug. For other types of plugs, no depression or groove is necessary. It may be useful to provide a flat upper housing side in which a plurality of female contacts are provided. As a rule, at least two female connectors should be provided that form a female connector pair for receiving a plug of a standard. It may be useful to provide a plurality of female connector pairs in order to be able to receive a plurality of plugs of different standards. If the plugs also have grounding conductors and the plug receptacle is intended to provide the opportunity of grounding, as a rule it is also necessary to provide a third female connector or a third contact per plug to be received.

The travel plug adapter should furthermore have at least a plug of a first standard and a second plug of a second standard. (Such plugs are sometimes also called plug-in pin sets). The plug of the first standard may be, for instance, an EU plug, and the plug of the second standard may be a US plug. The plugs may have two pins, that is, they may not be grounded, or they may have three pins, so that a grounding pin may be provided. The present travel plug adapter is thus suitable for use in more than one country. Usefully, and as a rule, it is also necessary for the first plug and the second plug to be used alternatively.

The travel plug adapter may also comprise three or more plugs. Travel plug adapters with three or four plugs have proved to be very useful. At least one of the plugs, but as a rule all of the plugs, may be moved from a standby position, in which the plug is essentially disposed in the housing, to a usage position. In the usage position, the plug is usably disposed entirely or at least in part outside of the housing. Often it is possible for the plug to be moved completely back into the housing when it is returned to the standby position. It is useful that the plug may be moved far enough back into the housing that it is not in the way of other plugs.

The first plug is connected to an actuation slider for moving it from the standby position into the usage position. The second plug is also connected to an actuation slider for moving it from the standby position to the usage position. Thus the travel plug adapter has at least a first actuation slider and a second actuation slider. The actuation sliders may usefully be embodied in a button-like manner so that they are easy to move with one finger. For the actuation sliders, slide slots are provided in the housing. Slide slots may also be connected to one another so that a guide track for the actuation sliders results. As a rule it is useful to provide one slide slot per actuation slider and to arrange these slide slots parallel to one another.

A sliding selector that may be moved into at least a first position and a second position may be provided on the travel plug adapter. This sliding selector releases, alternatively, in its first position the first plug and in its second position the second plug, so that the plug can be moved into the usage position. For this purpose the sliding selector has a blocking element, and for example cams can be used as blocking element, which cams engage with the displacement track. However, within the scope of the present invention it is not necessary to provide such a sliding selector. Said sliding selector is optional and can be used in addition to the means described later.

Since the travel plug adapter should always be constructed compactly, the actuation sliders are generally situated very close to one another. It may therefore easily happen, for instance, that a finger is not placed precisely on the actuation slider and an adjacent actuation slider could be inadvertently displaced at the same time. However, since the present invention only permits the actuation of one plug, and thus (as a rule) only one actuation slider, as well, the actuation slider that is inadvertently also touched does not move (or it does not move the associated plug, at least). This renders operation of the travel plug adapter more error-tolerant.

It is useful, as mentioned, when the housing of the travel plug adapter has slide slots or similar recesses. The actuation sliders may run in these slide slots. A slide slot may also be provided additionally for a sliding selector. Slide slots permit the movement of a slider while it is also being guided. Thus they represent an advantageous and cost-effective mechanical solution.

Since, as a rule, a plurality of actuation sliders are provided on the travel plug adapter, it is particularly advantageous when they may be guided in the slide slots in a simple manner. In the context of the present invention, the actuation sliders must only cause the movement of the plugs, as a rule an up and down movement. The actuation sliders (in contrast to other common adapters) do not have to lock the plugs in the usage position, nor ensure that only one plug may be selected at any time. Because the actuation sliders in the context of the present invention are permitted to carry out only one function, they may be easily and reliably guided in slide slots. If the actuation slider was spring-loaded, for instance, guidance in a slide slot would be less user-friendly, as a rule, because the slider would tend to cant, would run "hook-like," and would certainly have greater resistance.

A travel plug adapter can usefully have at least a first plug of a first standard and a second plug of a second standard. Here, each plug is assigned an actuation slider. Furthermore, each plug is to be assigned a blocking element, i.e. the first plug is assigned a first blocking element and the second plug is assigned a second blocking element. This blocking element blocks the displacement of the plug between the standby position and the usage position when the movement of the blocking element is blocked.

Furthermore, at least one blocking slide is provided, which in a first position releases the path of the first blocking element and in a second position blocks the path of the first blocking element. Here, the second blocking element can act on the position of the blocking slide. The at least one blocking slide can thus interact with the first and the second blocking element such that the movement of at least one blocking element is blocked.

As explained, it is desirable for safety reasons alone that only the first plug or the second plug can be transferred, alternately, into the usage position. In order to achieve this, a certain cooperation between the plugs is thus necessary. This cooperation is conveyed within the scope of the present invention by the blocking slides. Because the second blocking element acts on the position of the blocking slide, it can ensure that the blocking slide blocks the displacement of the first blocking element and therefore of the first plug.

The blocking slide can be guided in different ways, for example it could run on a pole which engages around the slide or it could also be supported by other housing parts, such as a housing wall. It is useful when the blocking slide is guided on a displacement track. This track supports the slide on one side, and can also surround it in a U-shaped manner, i.e. for example the underside can provide a track and at the same time can provide an additional guide to the opposing sides of the blocking slide.

It is also expedient when the at least one blocking slide is resiliently pre-stressed towards an end of the displacement track. The blocking slide is then pressed permanently against the end of the displacement track. This can be achieved expediently with a spring at the opposite end of the displacement track, for example with a coil spring. The pre-stressing of the blocking slides means that they are always held in predetermined positions at an end of the displacement track.

Particularly if a number of blocking slides are used on the displacement track, the position of the gaps between two blocking slides is thus also predetermined. A blocking element can engage in such a gap between the blocking slides. This makes it possible for the plug assigned to the blocking element to be transferred into the usage position.

It is expedient that, when a blocking element engages in a gap between two blocking slides or between a blocking slide and an end piece of the displacement track, the engagement of a further blocking element in such a gap is not possible. Accordingly, it is expedient that the length of the displacement track is dimensioned such that only the engagement of one blocking element at any time in a gap between blocking slides is possible.

It is expedient to arrange the at least one blocking slide (or possibly all blocking slides) above the slide slots. This means that the slide slots remain free from blocking elements. On the one hand, this results in a cleaner appearance of the slide slots and therefore of the travel plug adapter as a whole. On the other hand, the partial dipping of plugs and assigned actuation elements into the slide slots can thus be avoided. This partial dipping leads to an unclear plug position, which is often confusing for the user.

In addition, this arrangement makes it possible to form the travel plug adapter in a compact manner. In this sense it is also expedient to arrange the at least one blocking slide (or possibly all blocking slides) behind the slide slots.

It is also expedient when at least one first blocking slide of a first length and one second blocking slide of a second length are used, wherein the second blocking slide is longer than the first slide. In this way, it is possible to compensate for different distances between the slide slots, and it is also possible to accommodate blocking elements of different thickness or, in respect of individual blocking elements, to particularly effectively prevent the blocking element from dipping into a gap between the blocking slides.

The blocking elements can be formed in various expedient ways. The plugs typically have guide elements, for example a supporting bar. The blocking element can be fixedly connected to a guide element of this type or, as appropriate, an element attached to the guide element. By way of example, the blocking element can have the form of a cam or a lug. Here, the blocking element can also be formed in one piece with the corresponding guide element. The blocking element, however, in this case is an element different from the actuation element.

It is also expedient to form the blocking elements as separate components, i.e. generally elements which are movable independently of the movement of the guide elements. The blocking elements are preferably also movable separately. By way of example, the blocking elements can be formed as levers, in particular as tiltable levers. The axis of rotation of such tiltable levers can be oriented parallel to the axis of the displacement of the blocking slides on the displacement track. By way of example, it is expedient when the tiltable levers have a cam which can engage in a groove of a guide element of the plugs.

It is advantageous when the at least one blocking element (or possibly all blocking elements) are connected to a control lever which allows or blocks the transfer of the at least one blocking element (or possibly all blocking elements) into the open position. The control lever or finger can be embodied as a separate element and can be connected to the blocking element or also can be formed in one piece with the blocking element. By way of example, a U-shaped lever has proven to be of use, of which one lever end has an element or in particular a projection, which can cooperate with the plug or in particular a supporting element of the plug. The other end of the U-shaped lever can then serve as a control lever or finger.

The control levers or fingers can engage in a locking mechanism, in particular a blocking slide of a locking mechanism.

The plugs may be brought into the usage position with the aid of the actuation sliders. It is advantageous for safe use of the travel plug adapter that the plugs also remain in the usage position even when they are inserted into an outlet against a pressure. In the framework of the present invention, an arresting or locking element may be provided to ensure that the plugs remain in the usage position and to arrest them there. This locking element may arrest at least one plug of the travel plug adapter; the locking element may also usefully arrest a plurality of or all of the plugs in the usage position.

It is useful when the locking element is connected to a release button that is provided on the exterior of the housing and is to be actuated in a release direction. Such a release button permits intuitive and safe release of the locking element when a plug is to be moved out of the usage position back into the standby position. This design appears safer and more reliable than those in which certain movements of the actuation slider or even the sliding selector or even the plug itself lead to releasing the plug. So that the release button cannot be actuated inadvertently, it may also be provided with warning indicators or be designed in a warning colour, for instance in red. The release button may be part of the housing, for instance if due to suitable design a part of the housing can be depressed. As a rule it is useful to provide a recess in the housing and to provide the release button in this recess as a part that is independent of the housing. The release button may usefully be arranged opposing the sliding selector and/or the actuation sliders.

It is useful when the locking element, if any, is resiliently pre-stressed against the release direction. Resiliently pre-stressing the locking element permits plugs to be reliably snapped into a lock as soon as the plugs are in the usage position. It is also advantageous mechanically when the springs act precisely against the release direction.

A useful embodiment of an (optional) locking element is an embodiment in which the locking element has at least one locking leg and this locking leg has a slide surface and a locking projection. An element that is connected to a moved plug may slide on the slide surface. This element may then snap in at the locking projection so that the plug connected to the element is locked.

A travel plug adapter is useful in which at least one plug has a sliding projection or is mechanically securely connected to such and the sliding projection runs on the slide surface and can assume a locking position on the locking projection, if any.

Also useful is a travel plug adapter in which the locking means has a plurality of locking legs, for instance two, three, or four locking legs. The number of locking legs may be exactly the same as the number of plugs. It may also be useful and sufficient when the number of locking legs is less than the number of plugs.

Especially in the latter case it is useful when at least two plugs are each connected to a sliding projection and both sliding projections run on the same locking leg of the locking element. Since the two sliding projections run on the same locking leg, this means that the two sliding projections run on the same slide surface and on the same locking projection on which the two sliding projections can assume a locking position. Because two plugs in the travel plug adapter are not supposed to be moved into the usage position at the same time, the sliding projections alternatively assume this locking position on the locking projection. However, if two sliding projections, for instance two sliding projections of adjacent plugs, share a suitably dimensioned locking leg, the number of locking legs may be reduced and the travel plug adapter may thus be constructed even more compactly.

Additional features, but also advantages, of the invention, result from the drawings in the following and the associated description. Features of the invention are described in the figures and associated descriptions in combination. These features may, however, also be included by an inventive subject matter in other combinations. Each disclosed feature should thus also be considered to be disclosed in technically reasonable combinations with other features. Some of the figures are have been slightly simplified and are diagrammatic.

Figure 2:
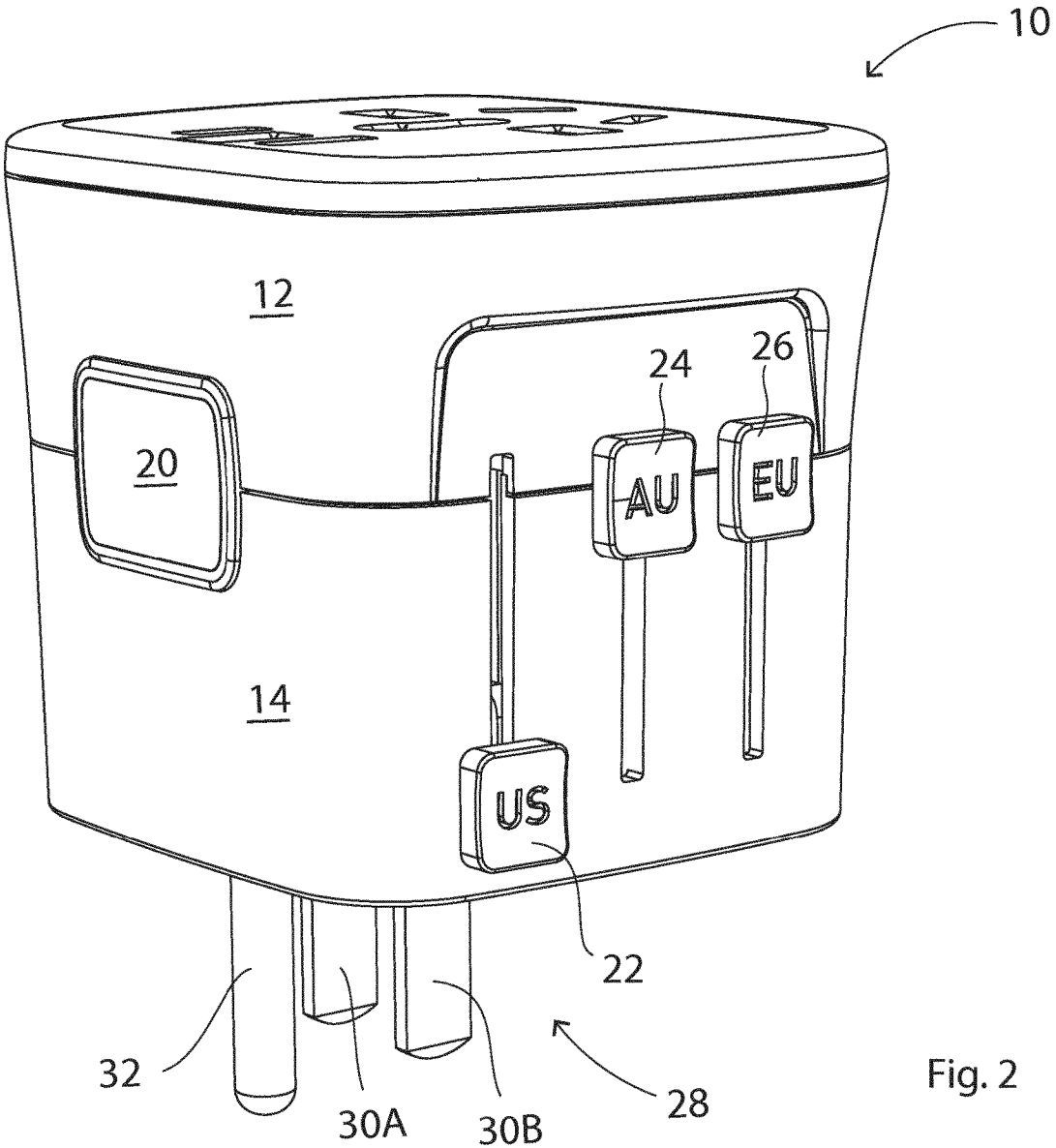
Figure 3:
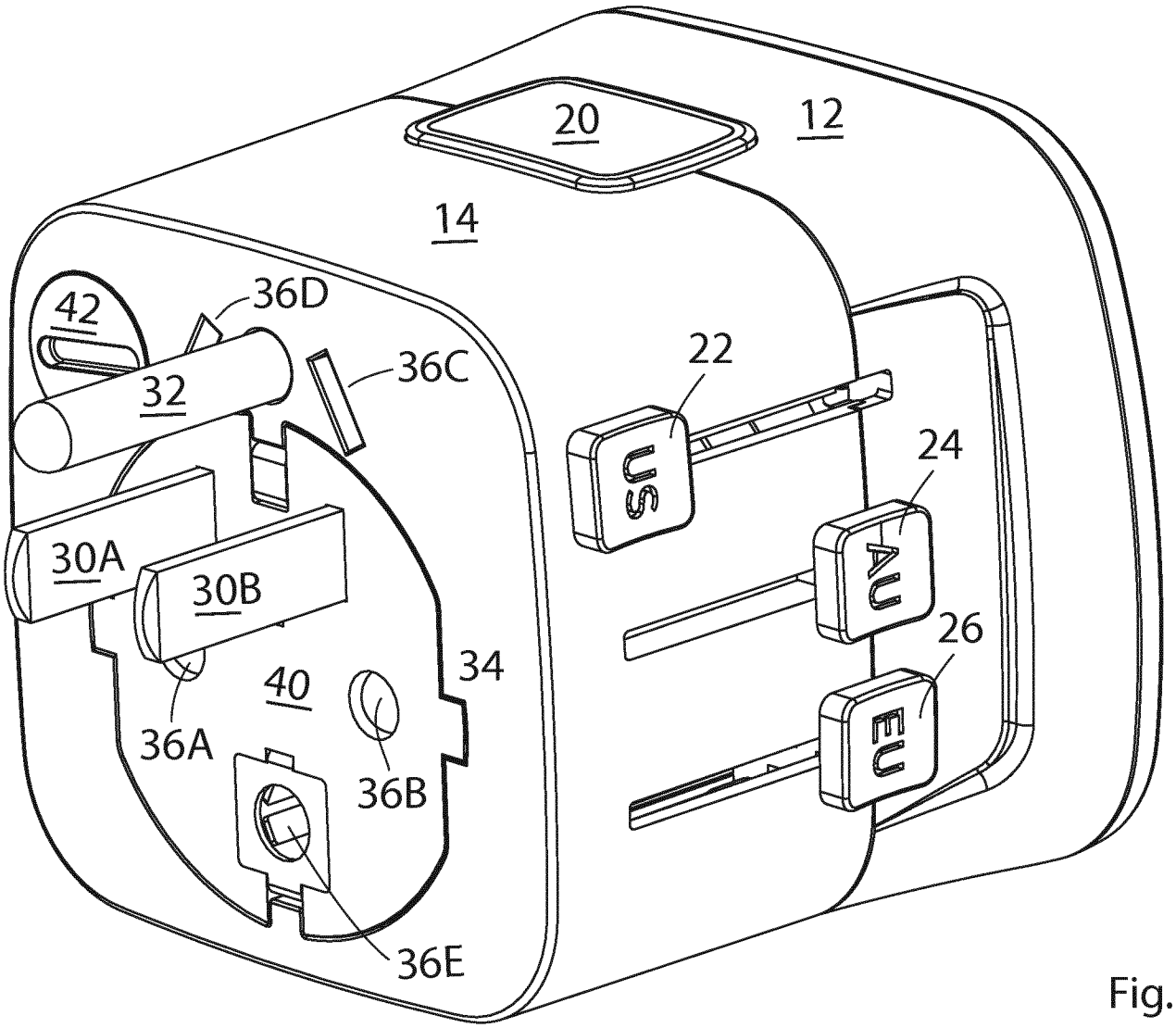
Figure 4:
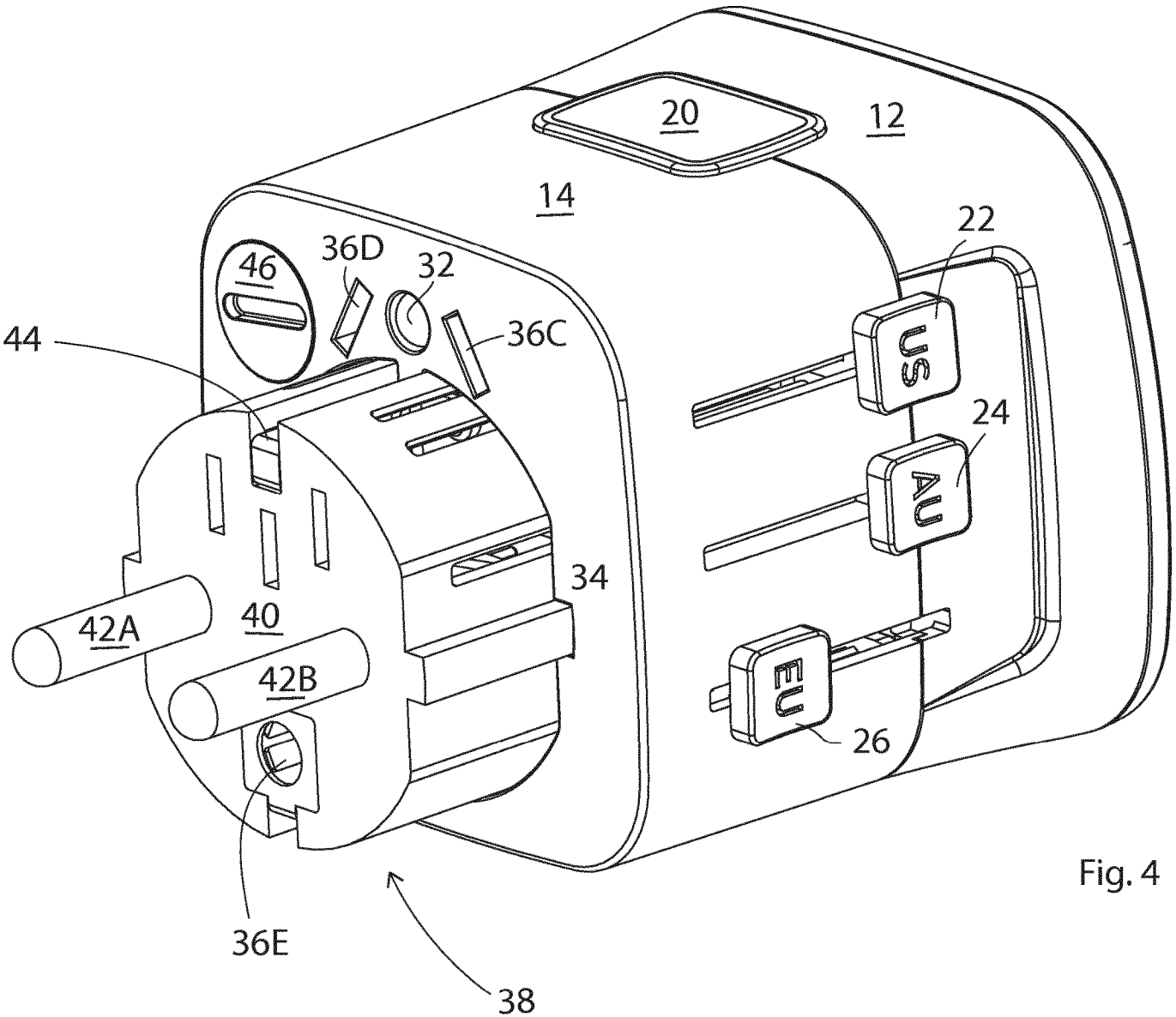
Figure 5:
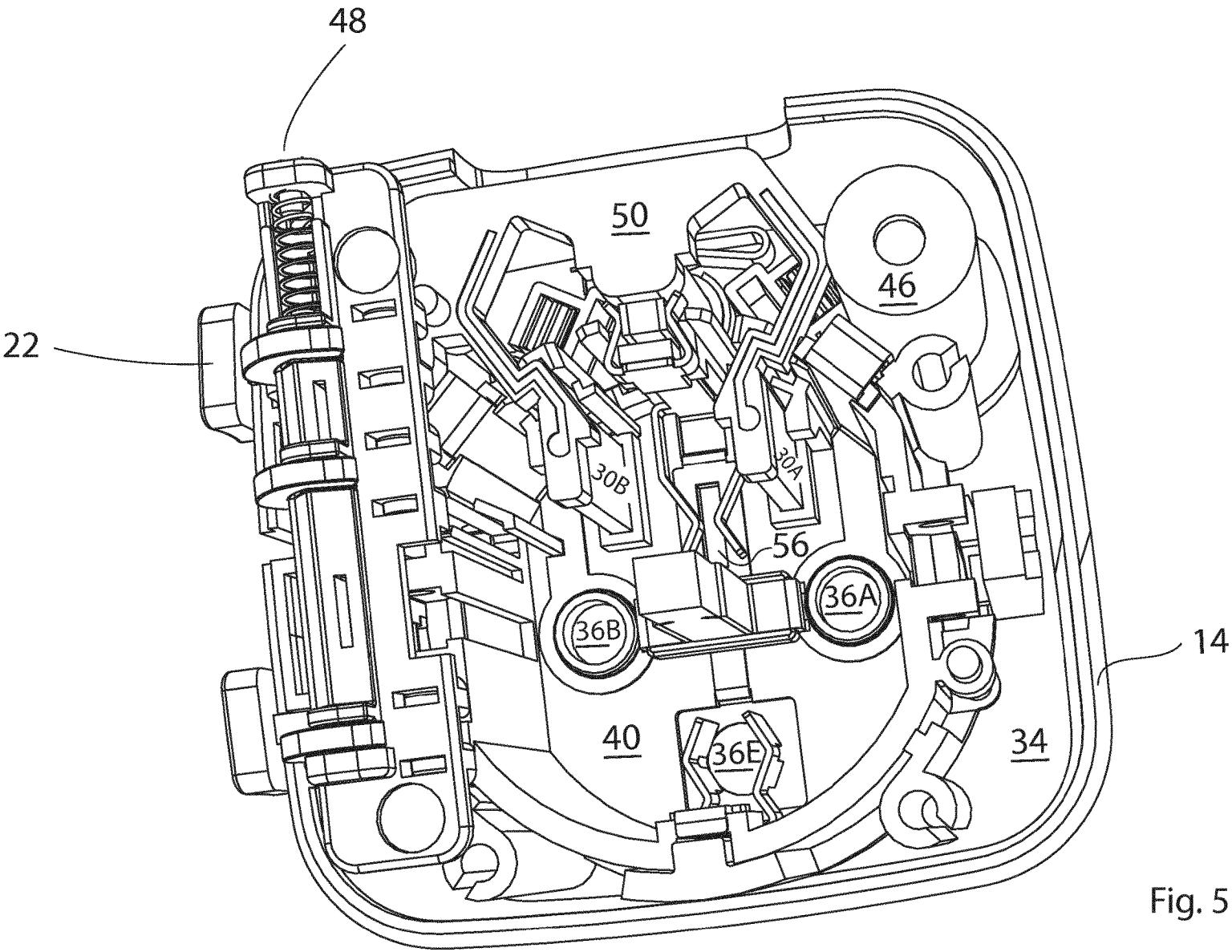
Figure 6:
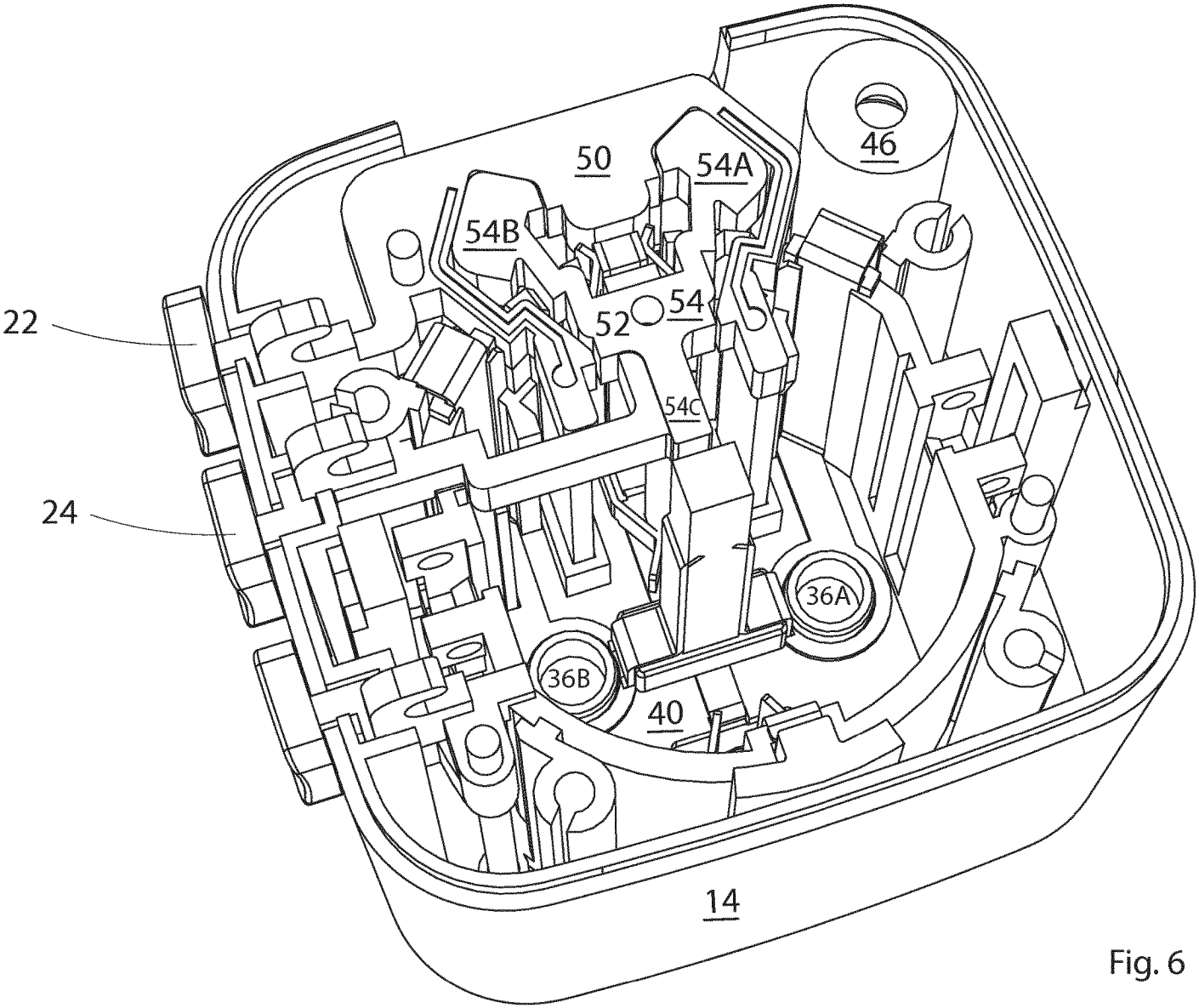
Figure 7:
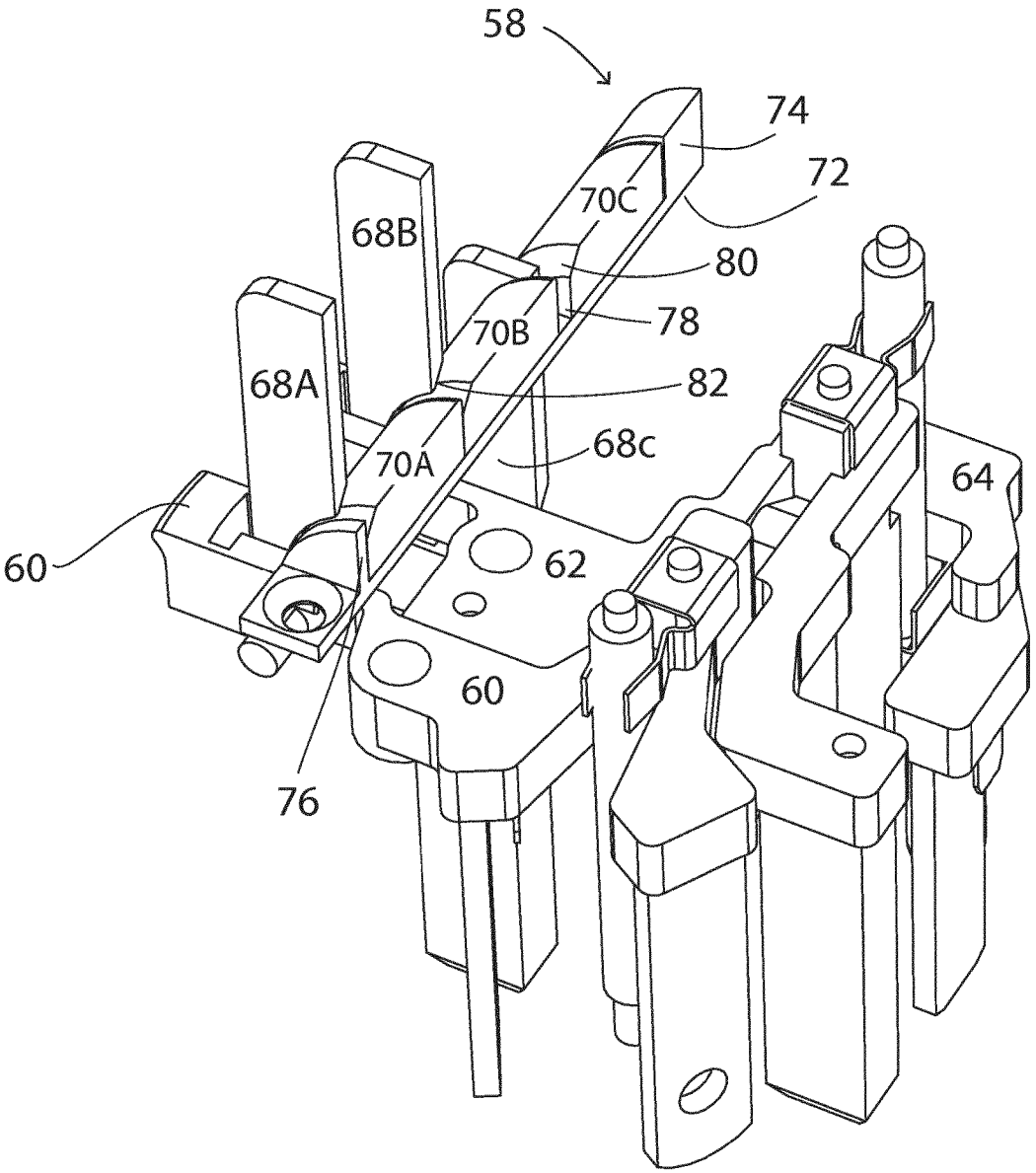
Figure 8:
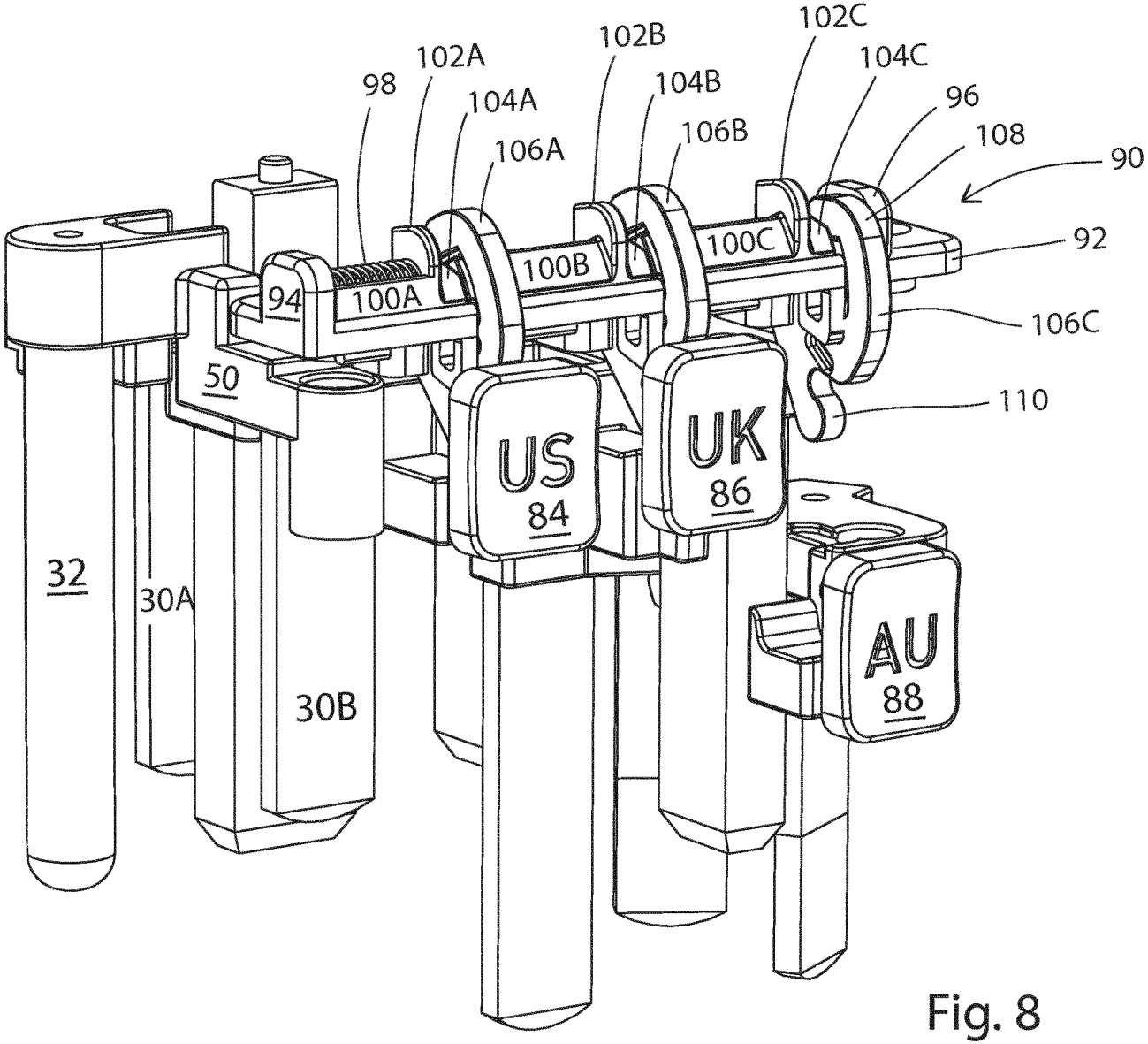
Figure 9:
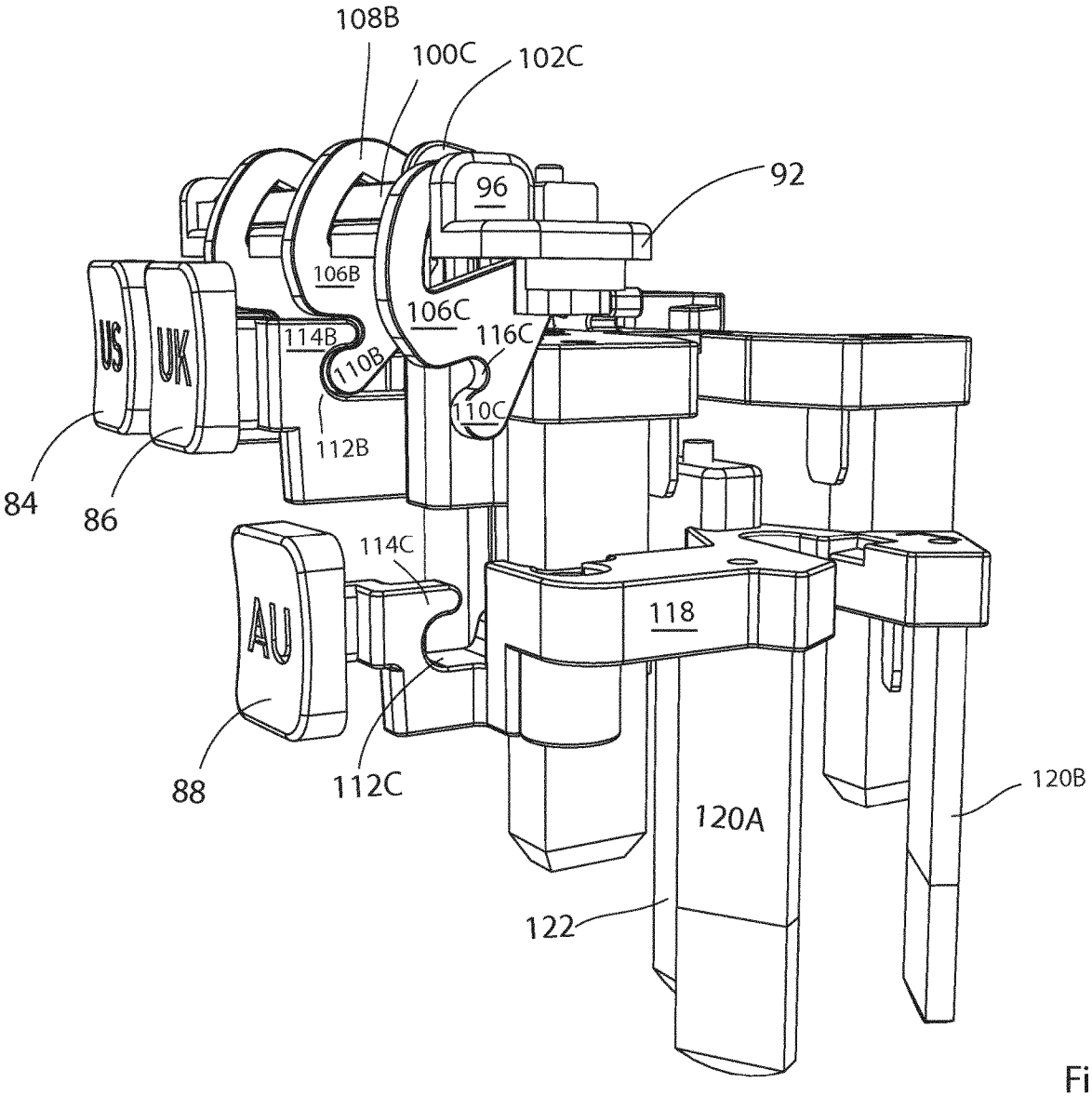

FIG. 1 is a perspective representation of an exemplary embodiment of an inventive travel plug adapter;

FIG. 2 provides a representation, from a similar perspective, of the exemplary embodiment of the travel plug adapter in which the US plug has been moved to the usage position;

FIG. 3 is a perspective representation of the travel plug adapter according to FIG. 2 in which the underside is visible, FIG. 4 is a corresponding perspective representation of the travel plug from FIG. 3 in which the Schuko plug has been transferred into the use position, FIG. 5 is a perspective elevation of selected cooperating components of the travel plug, FIG. 6 is a similar perspective elevation of selected cooperating components;

FIG. 7 shows, in selected cooperating components, an embodiment of a locking mechanism, FIG. 8 is a perspective elevation of selected cooperating components of another embodiment of the locking mechanism, FIG. 9 illustrates the components from FIG. 8 in a different perspective FIG. 1 is a perspective representation of an inventive travel plug adapter 10 that is ready for use, but is not yet in the usage position. Instead, all of the plugs are in the standby position, i.e., in the housing.

In the following, first the most essential elements of the travel plug adapter 10 shall be described. The travel plug adapter has a housing that consists of an upper housing part 12 and a lower housing part 14. The upper housing part 12 and the lower housing part 14 together form the main plug housing. Disposed on the top side of the travel adapter plug, and thus in the area of the upper housing part 12, is the plug receptacle 16. The latter has a plurality of female connectors 18. More specifically, these are the female connector pair 18A for receiving current-conducting UK contact pins, the female connector pair 18B for receiving current-conducting AU contact pins, the female connector pair 18C for receiving current-conducting US contact pins, the connector 18D for receiving a UK grounding pin, and the connector 18E for receiving a US grounding pin or AU grounding pin.

The release button 20 is also provided on the housing side. Said release button serves to lock and release actuation elements. On the housing front side there are provided the first actuation slider 22, by means of which the US contacts can be slid out, the second actuation slider 24, by means of which the AU contacts can be slid out, and the third actuation slider 26, by means of which a Schuko plug can be slid out.

FIG. 2 is a perspective representation of the exemplary embodiment of the travel plug adapter according to the invention in which the actuation slider 22 has been transferred into its lower position. The contact pins for the US plug 28 protrude from the housing accordingly. The US plug 28 comprises two current-conducting contact pins (the pins 30A and 30B) and also a grounding pin 32. In the illustrated position the travel plug can be inserted into an outlet according to the US standard. This standard does not require a plug body to be used. The housing underside of the travel plug adapter 10 then lies flush on the flat surface of the plug according to the US standard.

In FIG. 3 the same travel plug is illustrated from a different perspective. Here, it can be clearly seen that the underside 34 is planar. However, a multiplicity of openings 36 and elements are provided on this underside. The openings 36A and 36B are provided for current-conducting Schuko contact pins. The openings 36C and 36D are provided for current-conducting AU contact pins. The opening 38 is provided for an additional grounding pin. The opening 38 is provided together with the openings 36A and 36B in the plug body 40 of the Schuko plug. In addition to this plug body, a securing insert 46 is also provided.

FIG. 4 provides a representation, from the same perspective, of the travel plug adapter according to the invention in which the Schuko plug has been moved to the usage position. The third actuation slider 26 has been brought into its lower position, accordingly. The plug body 40 of the Schuko plug protrudes beyond the underside 34 of the housing. The current-conducting contact pins 42A and 42B of the Schuko plug in turn protrude from the Schuko plug. In accordance with the standard, grounding contacts 44 are disposed on the sides of the plug body.

FIG. 5 is a perspective elevation of selected cooperating components of the travel plug 10. With the upper housing part removed, it is possible to see into the inside of the plug, i.e. substantially those components that are received by the lower housing part 14 can be seen. It should also be noted that not all components necessary for the function of the plug are illustrated. For the sake of clarity, a selection has been made.

The plug body 40 of the Schuko plug can be seen. In this, there are provided the openings 36A and 36B for the current-conducting contact pins of the Schuko plug. The opening 36E, which is provided for a grounding contact pin, can also be seen. In this representation a further opening can also be seen—the opening 56 for the grounding pin of the AU plug.

The current-conducting contact pins 30A and 30B for the US plug are also illustrated. These are in their standby position, i.e. are retracted into the housing. The first actuation slider 22 is in the upper position, accordingly. The actuation slider 22 can be held in this position by the locking mechanism 48.

The actuation slider 22 moves the supporting bar 50. The contact pins 30A and 30B are fixed to this supporting bar 50. The supporting bar 50 travels downward accordingly as the first actuation slider 22 is displaced in the direction of the base of the housing. In so doing, the contact pins 30A and 30B are guided in the plug body 40 of the Schuko plug. The Schuko plug thus provides a guide for contact pins of another standard.

FIG. 6 is a similar perspective representation of a similar selection of cooperating components. Here, as key difference from FIG. 5, the supporting bar 52 for the AU plug can also be seen. The supporting bar 52 is connected to the actuation slider 24. The supporting bar 52 has three bar ends, the bar ends 54A, 54B and 54C, which merge in the region 54. The bar ends 54A and 54B support the current-conducting contacts of the AU plug. They guide these contacts mechanically from the (shown) standby position into the usage position. The bar end 54C guides the AU grounding pin. The grounding pin is thus transferred from the (shown) standby position into the usage position through the opening 56 visible in FIG. 5.

An arrangement in which the current-conducting pins are guided outside the plug housing 40 of the Schuko plug is thus selected for the AU plug, in contrast to the grounding pin within the plug housing 40 of the Schuko plug. By contrast, the current-conducting contact pins for the US plug are guided within the plug body 40 of the Schuko plug. Both solutions allow an advantageous and space-saving arrangement. Different solutions can be selected for different plugs.

FIG. 7 is a perspective elevation of selected cooperating components of the travel plug 10. A first supporting frame 60, which as guide element supports and guides various contact pins (not denoted in greater detail), is illustrated. A second supporting frame, which similarly guides a plurality of contact pins, is also illustrated. A third supporting frame 64 is also illustrated. The supporting frames 60 and 62 are illustrated in an upper position, i.e. in a position which corresponds to their standby position. The third supporting frame 64 is illustrated in a position displaced downwardly, which corresponds to the usage position. The supporting frame 60 is connected to the actuation element 66. The rest of the supporting frames are connected similarly to actuation elements, however these are not visible from this perspective. In addition, the supporting frames are connected to head pieces, specifically the supporting frame 60 is connected to the head piece 68A, the supporting frame 62 is connected to the head piece 68B, and the supporting frame 64 is connected to the head piece 68C.

Three blocking slides are also provided, i.e. the blocking slides 70A, 70B, and 70C. These blocking slides run on the displacement track 72. This displacement track 72 extends between a first end 74 and a second end 76. At the two ends, delimitation elements are provided, which delimit the running of the blocking slides at both ends of the displacement track 72. In the first end piece 74, a coil spring can also be provided (not shown), which exerts pressure on the blocking slide 70C so that this is pre-stressed towards the second end piece 76 of the displacement track 72. The pressure is transferred from the blocking slide 70C to the blocking slides 70B and 70A, such that all blocking slides are resiliently pre-stressed towards the second end piece 76 of the displacement track 72.

The usable length of the displacement track 72, i.e. the length between the first end piece 74 and the second end piece 76, is slightly longer than the sum of the lengths of the blocking slides 70A, 70B and 70C. A gap 78 can thus be formed between the blocking slides 70. A head part of a supporting frame can engage in this gap. In the plug position of FIG. 7, the head part 68C engages in the gap 78 between the blocking slide 70B and the blocking slide 70C. The head part 68C can be moved through the gap, such that it reaches the shown lower position, which corresponds to the usage position of the plug assigned to the supporting frame 64. In this position, however, the head piece 68C fully fills out the available length on the displacement track 72 together with the blocking slides 70A, 70B and 70C. Consequently, there is no longer a gap or any play allowing the head parts 68A and 68B to enter into engagement with the blocking slides—in other words there is no longer any space for a second gap, which would allow the passage of another head part.

In this way, a locking mechanism 58 can thus be created, which ensures that just one plug at any time is transferred into its usage position. The blocking slides can be provided at the edges with a bevel 80. This allows the easy passage of a head piece 68. Correspondingly, the head pieces 68 can have a tapered point in the form of a cutting end 82 at their lower edge. This also facilitates the insertion of the head piece 68 into a gap between the blocking slides 80. However, the usable length of the displacement track 72 should in any case be dimensioned such that, in spite of such insertion and passage aids, not more than one head piece 68 can be transferred into the usage position. On the whole, a simple and precisely functioning mechanism can thus be created, which makes the additional provision of a sliding selector superfluous. The mechanism also ensures that the actuation elements each assume a clear standby position or usage position. The user is never in doubt as to which state a plug is currently in. Travel plug adapters from the prior art, by contrast, sometimes allow a partial transfer of plugs in the direction of the standby position, for example when blockers only engage late in the slide slots.

FIG. 8 shows a perspective elevation of selected components, on the basis of which an embodiment of a locking mechanism that is expedient within the scope of the present invention can be identified. Three actuation elements are illustrated in the form of a first actuation slider 84 for a US plug, in the form of a second actuation slider 86 for a UK plug, and in the form of a third actuation slider 88 for an AU plug. Of course, the illustrated locking mechanism 90 can also cooperate with other plugs, for example the arrangement shown in FIG. 1. The locking mechanism 90 in turn comprises a displacement track 92 as an element. This displacement track 92 extends between the first end piece 94 and the second end piece 96. A coil spring 98 is provided bearing against the first end piece 94 and is suitable for pre-stressing the various blocking slides towards the second end piece 96 of the displacement track 92 in a resilient manner.

The coil spring 98 is arranged in the first blocking slide 100A. It also acts (conveyed via this slide) on the second blocking slide 100B and on the adjacent third blocking slide 100C. The blocking slides are each provided with guide cheeks, i.e. the guide cheeks 102A, 102B and 102C. Bevels are also provided at the ends of the blocking slides, i.e. the bevels 104A, 104B, and 104C.

Rocker levers are arranged above the displacement track 92. Each actuation element and thus plug is assigned its own rocker lever. The rocker lever 106A is assigned to the actuation element 84, the rocker lever 106B is assigned to the actuation element 86, and the rocker lever 106C is assigned to the actuation element 88. The rocker levers rotate about an axis of rotation (not illustrated) below the displacement track 92. The axes of rotation run substantially parallel to the displacement track 92. Each rocker lever has a control finger 108 formed in one part therewith. For the sake of clarity, this has only been indicated in greater detail for the rocker lever 106C. A blocking cam 110 is provided opposite the control finger 108. The blocking cam can enter into engagement with the associated actuation element and can fix this in the standby position. The mechanics effective here will be explained in greater detail in conjunction with the next drawing.

What can be seen from this representation is that the rocker lever 106C is in a lower position. In this position, the control finger 108 is directly above the displacement track 92. In this position, the control finger can pass only when there is a suitable gap between the blocking slide 100C and the second end piece 96. The control finger 108 engages in this gap. The guide cheek 102C and the bevel 104C ensure that, as the rocker lever 106C moves, the control finger 108 can dip reliably into this gap. The gap is dimensioned such that, once the control finger has dipped into said gap, a displacement of the blocking slides 100A, 100B or 100C is no longer possible. The same is also true similarly for the control fingers of the other rocker levers.

When the rocker lever 106C is transferred into its upper position, which corresponds to the standby position of the actuation slider 88, in which the control finger 108 is disposed above the blocking slide 100C, there is space to displace all three blocking slides. Accordingly, the rocker lever 106B, which is assigned to the actuation slider 86, could then be transferred into a lower position. Here, its control lever, guided by the guide cheek 102B and the bevel 104B, would slide the blocking slide 110C away to the right towards the second end piece 96. However, this would be possible due to the fact that a gap is available there on account of the corresponding position of the rocker lever 106C.

FIG. 9 shows, from a different perspective, the selected components illustrated in FIG. 8 of an embodiment and again the actuation sliders 84, 86 and 88. The actuation sliders 84 and 86 and the corresponding plugs are in the standby position. The actuation slider 88 and the corresponding plugs are in the usage position. Only the parts essential for describing the operating principle of the rocker lever have been indicated. For the rocker lever 106C, it can be seen that the blocking cam 110C can engage with a corresponding engagement part 112C on the actuation slider 88. Such an engagement part can be embodied generally expediently as a groove. A counter cam 114C is additionally provided on the actuation slider. When the actuation slider is transferred into its upper position corresponding to the standby position, the counter cam 114C presses against the pressure surface 116C on the rocker lever 106C. This causes the rocker lever 106C to be moved back into its upper position. Here, the blocking cam 110C engages with the engagement part 112C. A form-fitting connection is thus established, which holds the actuation slider 88 in the upper position. The rocker lever could also be spring-loaded in order to securely hold the position independently of the position of a blocking slide. However, as soon as the blocking slide 100C is displaced and the position of the rocker lever 106C is fixed via the control finger 108, the actuation slider 88 is held securely and fixedly in its upper position.

The securing of the upper position can be clearly seen for the actuation slider 86. Here, the blocking cam 1108 is fixedly connected to the engagement part 112B of the actuation slider 86. In addition, the counter cam 114B is engaged with the rocker lever. The blocking slide 100C prevents the control lever 108B and therefore the rocker lever 106B as a whole from being able to be moved downwardly.

In this perspective illustration it can also be clearly seen that the fixing in the region of the blocking cam 110C can securely fix all elements of the plug. Only when the rocker lever releases the engagement part 112 can the supporting bar 118 for the AU plug be moved downwardly. This supporting bar guides both the current-conducting contacts 120A and 120B and also the grounding contact 122 reliably downwardly and upwardly again.

In the manner described generally, and described more specifically in the drawings, a travel adapter may be produced that is very comfortable to operate, but in which almost no operating errors are to be expected. Interestingly, the travel adapter is nevertheless inexpensive to produce and may also be produced inexpensively and reliably even if greater fault tolerances must be permitted during mass production.

REFERENCE LIST

10 Travel adapter/travel plug adapter
12 Upper housing part
14 Lower housing part
16 Plug receptacle
18 Female connector
18A UK female connector pair
18B AUS female connector pair
18C US female connector pair
18D Female connector for UK grounding pin
18E US grounding pin
20 Release button
22 First actuation slider
24 Second actuation slider
26 Third actuation slider
28 US plug
30 Current-conducting contact pins (US plug)
32 Grounding pin (US plug)
34 Plug body (Schuko plug)
36 Openings
36A Opening of current-conducting contacts (Schuko)
36B Opening of current-conducting contacts (Schuko)
36C Opening of current-conducting contacts (US)
36D Opening of current-conducting contacts (US)
36E Opening of further grounding contact
38 Schuko plug
40 Schuko plug body
42 Current-conducting contacts of Schuko plug
44 Grounding contact of Schuko plug
46 Fuse compartment
48 Locking mechanism
50 Supporting bar US
52 Opening of grounding pin
54 Supporting bar AU
56 Supporting bar ends AU
58 Locking mechanism
60 First supporting frame—guide element
62 Second supporting frame—guide element
64 Third supporting frame—guide element
66 Actuation element
68 Head piece
70 Blocking slide
72 Displacement track
74 First end piece of displacement track
76 Second end piece of displacement track
78 Gap
80 Bevel on blocking slide
82 Cutting end
84 Actuation element US
86 Actuation element UK
88 Actuation element AU
90 Locking mechanism
92 Displacement track
94 First end piece
96 Second end piece
98 Coil spring
100 Blocking slide
102 Guide cheek
104 Bevel
106 Rocker lever
108 Control finger
110 Blocking cam
112 Blocking cam engagement part
114 Counter cam
116 Pressure surface
118 Supporting bar AU
120 Current-conducting contacts AU
122 Grounding contact AU

The invention claimed is:

1. A travel plug adapter (10), which has a housing, a plug receptacle (16), and at least a first plug (38, 84) of a first standard and a second plug (28, 86) of a second standard, wherein each plug is assigned an actuation slider (22, 24), which is guided outwardly through a slide slot of the housing and is designed to displace the plug between a standby position, in which the plug is disposed substantially inside the housing, and a usage position, in which the plug is usably disposed outside the housing, and wherein the first plug (38, 84) is assigned a first blocking element (106A), such that displacement of the first plug (38, 84) between the standby position and the usage position is blocked when the movement of the first blocking element (106A) is blocked, and wherein the second plug (28, 86) is assigned a second blocking element (106B), such that the displacement of the second plug (28, 86) between the standby position and the usage position is blocked when the movement of the second blocking element (106B) is blocked, characterised in that at least one blocking slide (100A) is also provided, which in a first position releases the path of the first blocking element (106A) and in a second position blocks the path of the first blocking element (106A), wherein the second blocking element (106B) acts on the position of the blocking slide (100A).

2. The travel plug adapter (10) according to claim 1, in which the at least one blocking slide (100A) is guided on a displacement track (92).

3. The travel plug adapter (10) according to claim 1, in which the at least one blocking slide (106A) is resiliently pre-stressed towards an end of the displacement track (92).

4. The travel plug adapter (10) according to claim 1, wherein the length of the displacement track (92) is selected such that only one blocking element at any time can engage in a gap between blocking slides (100).

5. The travel plug adapter (10) according to claim 1, in which the at least one blocking slide (100A) is arranged above the slide slots.

6. The travel plug adapter (10) according to claim 1, in which the at least one blocking slide (100A) is arranged behind the slide slots.

7. The travel plug adapter (10) according to claim 1, in which at least one first blocking slide of a first length and a second blocking slide of a second length, which is greater than the first length, are used.

8. The travel plug adapter (10) according to claim 1, in which the blocking elements are fixedly connected to a guide element of a plug.

9. The travel plug adapter (10) according to claim 1, in which the blocking elements (106) are formed as separate components which can cooperate with an element of the plug guide (50, 54, 56, 118).

10. The travel plug adapter (10) according to claim 9, in which the blocking elements are formed as movable levers.

11. The travel plug adapter (10) according to claim 10, in which the blocking elements are formed as tiltable levers (106).

12. The travel plug adapter (10) according to claim 11, in which the tiltable levers (106) have a cam (110) which can engage in an engagement part (112) of a guide element of a plug.

13. The travel plug adapter (10) according to claim 1, in which a locking element is provided that arrests at least the first plug (38, 84) or the second plug (28, 86) in the usage position.

14. The travel plug adapter (10) according to claim 13, in which the locking element is connected to a release button (20) provided outside on the housing.

15. The travel plug adapter (10) according to claim 2, in which the at least one blocking slide (106A) is resiliently pre-stressed towards an end of the displacement track (92).

16. The travel plug adapter (10) according to claim 2, wherein the length of the displacement track (92) is selected such that only one blocking element at any time can engage in a gap between blocking slides (100).

17. The travel plug adapter (10) according to claim 2, in which the at least one blocking slide (100A) is arranged above the slide slots.

18. The travel plug adapter (10) according to claim 2, in which the at least one blocking slide (100A) is arranged behind the slide slots.

19. The travel plug adapter (10) according to claim 2, in which at least one first blocking slide of a first length and a second blocking slide of a second length, which is greater than the first length, are used.

20. The travel plug adapter (10) according to claim 2, in which the blocking elements are fixedly connected to a guide element of a plug.

* * * * *